US005182829A

United States Patent [19]

Sears

[11] Patent Number: 5,182,829

[45] Date of Patent: Feb. 2, 1993

[54] FASTENER HAND TOOL

[76] Inventor: Carroll Sears, P.O. Box 318, Wrightsville, N.C. 28480

[21] Appl. No.: 754,756

[22] Filed: Sep. 4, 1991

[51] Int. Cl.[5] ..... B25F 1/00

[52] U.S. Cl. ..... 7/166; 7/170; 29/278; 29/267

[58] Field of Search ..... 7/169, 151, 161, 170; 29/278, 280, 227, 267; 81/44, 488, 900; 16/125

[56] References Cited

U.S. PATENT DOCUMENTS

| | | | |
|---|---|---|---|
| D. 256,442 | 8/1980 | Martin | D10/77 |
| D. 275,446 | 9/1984 | McSwain | D8/89 |
| D. 282,344 | 1/1986 | Wilcox | D8/16 |
| D. 296,656 | 7/1988 | Johnson, Sr. | D8/89 |
| D. 314,321 | 2/1991 | Johnston | D8/89 |
| D. 318,005 | 7/1991 | Ryan et al. | D8/14 |
| 2,962,197 | 11/1960 | Spangler, Jr. | 16/125 |
| 3,540,160 | 11/1970 | De Rose et al. | 51/170 R |
| 3,918,140 | 11/1975 | Konstant | 29/278 |
| 3,965,776 | 6/1976 | Wolstenholme et al. | 81/3 R |
| 3,987,827 | 10/1976 | Mills | 145/1 A |
| 4,096,618 | 6/1978 | Perline et al. | 29/278 |
| 4,210,035 | 7/1980 | White | 81/3 R |
| 4,475,276 | 10/1984 | Staten | 29/229 |
| 4,627,126 | 12/1986 | Nichols | 15/105 |
| 5,079,791 | 1/1992 | Grech | 7/169 |

OTHER PUBLICATIONS

Undated p. 49 from a 1991 Sears ® catalogue showing various tools.

Two (2) photographs showing Tools on the Market.

*Primary Examiner*—Roscoe V. Parker

*Attorney, Agent, or Firm*—Olson & Hierl, Ltd.

[57] ABSTRACT

A hand tool comprising a lever body is disclosed for assisting in connecting and disconnecting multipiece fasteners. The lever body comprises at least one disconnecting end and at least one connecting end opposite the disconnecting end. In a preferred tool embodiment, the disconnecting end is shaped and oriented to disconnect a snap fastener. One portion of the connecting end defines a recess feature shaped and oriented for releasably retaining and capturing a snap fastener piece for connection or disconnection. In another preferred tool embodiment, the connecting end includes an elongated zipper hook and further defines a groove adapted for cooperatively pivotally mounting the hook, and for holding the hook in either an open position for use or in a closed position during nonuse.

22 Claims, 1 Drawing Sheet

FASTENER HAND TOOL

TECHNICAL FIELD

The present invention generally relates to fastener hand tools and, in particular, to a fastener hand tool for assisting in the connection and disconnection of a variety of multipiece fasteners.

BACKGROUND OF THE INVENTION

Multipiece fasteners have long been used for a multiplicity of applications. The term "multipiece fasteners" as used herein denotes fasteners having at least two mateable pieces which are intended to interlock tightly when connected and require some measure of force or assistance to connect one piece with or disconnect one piece from the other.

One commonly used type of multipiece fastener is a snap fastener having male stud and female socket mateable pieces which interlock with one another by a snap fit. Each separate piece is also typically further configured to separately grip and be attached to a surface material so that the snap fastener anchors one attached surface material to a second attached surface material. Snap fasteners are highly desirable for a number of applications because of their desirably tight interlocking feature, but this same desirable feature also presents problems during connection and disconnection under certain conditions.

For example, snap fasteners are particularly useful for securing protective coverings typically composed of flexible material, such as tarpaulins, canvas or plastic, to the body surfaces of marine crafts, campers, recreational vehicles and airplanes. For this purpose, a relatively heavy-duty snap fastener is used. Typically the mateable piece which includes the female socket portion is attached to some flexible covering. The second mateable piece which includes the stud portion is attached to the solid body surface of the item intended to be protected.

In particular, such protective covers are used in marine craft applications to protect open areas, such as cockpits of yachts, sail boats, motor boats and other marine craft from heavy weather and the elements generally during use or during storage. Similarly, covers are used to protect the windshields of airplane cockpits from the environment during nonuse. In automotive applications, convertible automobiles require covers to protect the open passenger compartment during rain or cold weather. In addition, covers are commonly used to protect the finish of parked or stored automobiles from the dulling effects of the sun and weather.

By design these protective covers are intended to fit tautly and require some force to disconnect the snap fasteners. A taut fit prevents the cover from being loosened by the wind. The wind can cause a rippling up and down motion of the cover. Such wind rippling can cause damage to the solid body surface of the supposedly protected object and defeats the protective purpose of the cover against the elements.

Additionally, some protective fabric covers are intended to shrink slightly during weathering, especially in a marine environment. Such shrinkage results in a taut seal which prevents the collection of water on the surface of the cover.

Consequently, the very tautness desired for the foregoing covers also causes difficulty in connecting or disconnecting these multipiece fasteners. The snap fasteners in these protective covers are generally interlocked in relatively close spatial relationship to the solid surface, so it is difficult to grasp and disconnect the fastener with adequate force using only the fingers of the hand. Likewise, it is equally difficult to use only the fingers of the hand to connect the snap fasteners of covers that have shrunk. In marine applications, snap fasteners can rust in a snapped closed position during long storage in salt water and are also frequently located in hard to reach crevices on the solid body surface of the crafts.

Consequently, persons have resorted to various undesirable methods to overcome these problems. For example, metal crowbars and nail pullers have often been used in an attempt to disconnect snap fasteners. Pliers and other grasping tools have been used to grasp and pull shrunken covers. The use of such hand tools frequently results in tearing or ripping the cover fabric away from the fastener, damage to either the fastener stud or female socket portions or in damage to the body surface of the craft, all resulting in costly repairs.

Another popular type of multipiece fastener is the zipper having mateable pieces, such as interlocking teeth, and a moveable head piece which connects or disconnects the teeth depending on the direction the head piece is pulled. The moveable piece usually includes a slot so that means for pulling the moveable piece, such as a tab or ring, can be attached to facilitate connecting and disconnecting of the zipper. Such pull tabs often include at least one slot which assist the user in grasping it with the fingers for pulling.

Zipper fasteners are also used in some of the foregoing protective coverings, for example, in the marine area and in tent coverings to provide removable clear plastic window inserts. On many boats, a wind spoiler cover includes a clear insert, known as isinglass, to provide visibility as well as protection during rough weather. These inserts are usually zippered so that they can be quickly and easily either inserted when rough weather threatens or removed after rough weather passes.

Problems arise, however, if the zippers are hard to reach or the pull tab has broken off making it difficult to move the head piece with the fingers. Persons have resorted to using pliers or other grasping tools causing damage to the isinglass insert and resulting in costly replacement.

Snap fasteners and zippers are also commonly used as closures for clothing apparel, such as sportswear, jeans, shirts, work clothes, housecoats and the like. For clothing applications, of course, relatively small snap fasteners are used. For persons who are arthritic, elderly, or otherwise physically challenged by having poor or no finger dexterity, connecting and disconnecting of multipiece fasteners on articles of clothing can be difficult and frustrating.

Accordingly, there is a need for a hand tool to assist in connecting and disconnecting of various multipiece fasteners, and snap fasteners in particular. The tool of the present invention meets this need.

SUMMARY OF THE INVENTION

A hand tool comprising a lever body is disclosed for assisting in connecting and disconnecting multipiece fasteners, particularly snap fasteners and zippers. Briefly described, the lever body comprises at least one disconnecting end and at least one connecting end opposite the disconnecting end and is hand graspable for one-handed use.

In one preferred tool embodiment, the disconnecting end preferably is forked and arcuately shaped to a leverage point. The forked disconnecting end is oriented to engage a fastener piece in tangential alignment with the leverage point to disconnect a snap fastener when a downward or push force is applied to the lever body. In one tool aspect, one portion of the connecting end defines a recess, which is shaped and oriented for releasably retaining and capturing a snap fastener piece for connection or disconnection when pull force is applied toward the disconnecting end.

In another preferred tool embodiment, the connecting end of the lever body 12 includes a pivotally mounted elongated zipper hook and further defines a groove. The groove is adapted both for cooperatively pivotally mounting the hook therein intermediate the disconnecting end and the connecting end and for holding the hook either in an open position for use or in a closed position during nonuse. For operative use, the zipper hook is rotatably positioned to be opposite the disconnecting end and held in this open position by the groove. The hook is attached to the moveable head piece or tab of a zipper and a pull force is applied toward the disconnecting end.

The forked portion of the disconnecting end preferably defines a semicircular notch beveled on one surface for releasably engaging the forked portion between two mated fastener pieces of a snap fastener.

In another preferred tool aspect, a lanyard can be included for disposing the tool about a user's hand for providing additional pull force during use, and for storing the tool during nonuse.

Numerous other features and advantages of the present invention will become readily apparent from the following detailed description of the invention, the accompanying drawings and the appended claims.

BRIEF DESCRIPTION OF THE DRAWINGS

In the accompanying drawings which form part of this disclosure.

DETAILED DESCRIPTION OF THE PREFERRED EMBODIMENT

Figure 1:
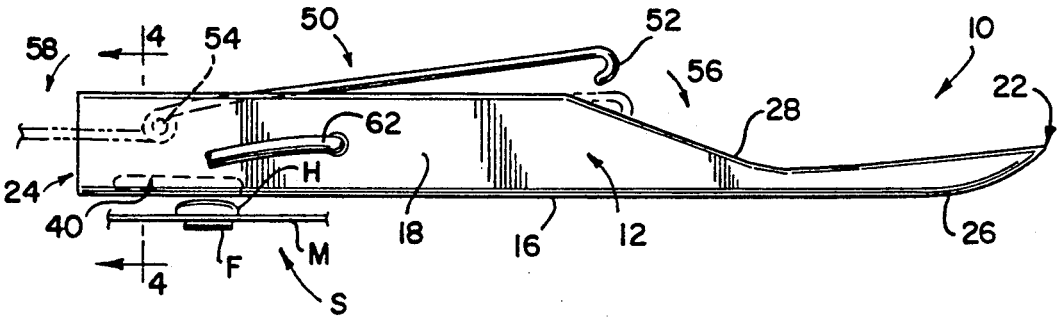
FIG. 1 is a side elevational view of a preferred hand tool embodiment showing the relationship of the disconnecting end to the connecting end, with the recess, pivotal mount for the zipper hook and groove features in shadow.

While this invention is susceptible of embodiment in many different forms, there is shown in the drawings one specific preferred embodiment which will be described in detail. The present disclosure is intended to exemplify the principles of the invention and is not intended to limit the invention to the embodiment illustrated.

For purposes of illustrating a hand tool embodying the principles of this invention, the connection and disconnection of snap fasteners and zippers in non-clothing applications is described for convenience and not by way of limitation.

Except for the overall size of snap fasteners, a snap fastener usually comprises a top prong member, usually a rounded head, a female socket, a male portion and a base. Usually, the top prong member includes prongs which grip a surface covering material, typically flexible fabric, and cooperate with the female socket to anchor the surface material therebetween. When the top prong member is mated with the female socket, the material is captured with little or no space remaining between the top prong member, the surface material and the female socket. Such a fastener head piece construction including the female socket is illustrated and designated generally as S in FIG. 1.

Accordingly, the corresponding male portion of a snap fastener comprises a stud. For clothing uses, the base of the male portion also comprises a bottom prong member which grips a surface covering material and the stud includes a ring portion which cooperates with the male portion to anchor material therebetween. Like the female portion, no space is left between the stud, the second surface material and the base. For non-clothing uses, however, the male portion and its base are directly attached to a solid surface.

Figure 2:
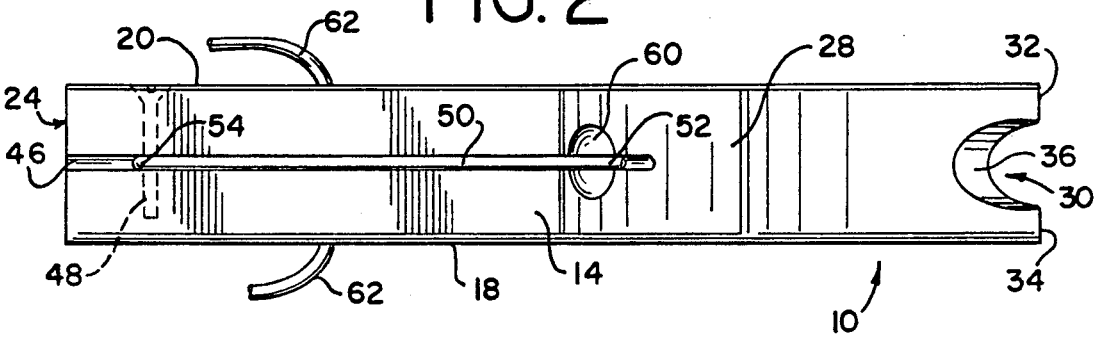
FIG. 2 is a top plan view of the embodiment shown in FIG. 1.
Figure 3:
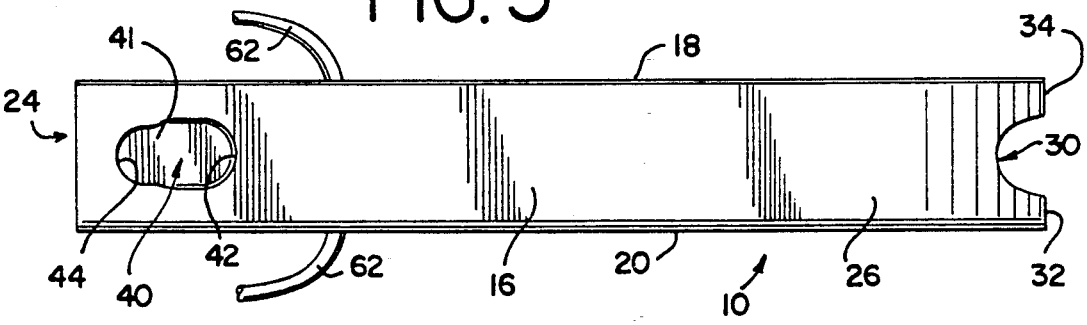
FIG. 3 is a bottom plan view of the embodiment shown in FIG. 1.

Referring to FIGS. 1–3, a preferred hand tool embodiment in accordance with the present invention is designated generally by the numeral 10.

As seen in FIG. 1, the tool 10 comprises a lever body 12 suitable for grasping with one hand. The lever body 12 has a disconnecting end 22 and a connecting end 24. As illustrated in FIG. 1, the lever body is preferably substantially solid and has a top surface 14, a bottom surface 16, a first side wall 18, and an opposing second side wall 20 substantially parallel to the first side wall (best seen in FIGS. 2–4). The side walls at the disconnecting end 22 have a height that preferably is dimensionally narrower than the side wall height at the connecting end 24. Thus, the connecting end 24, the top surface 14, bottom surface 16 and the side walls 18, 20 cooperate with one another to define a lever body 12 that is dimensionally larger towards the connecting end 24 than it is towards the disconnecting end 22. Accordingly, the top surface 14 is sloped downward towards the disconnecting end 22 to provide a sloped surface 28 intermediate the disconnecting end 22 and the connecting end 24.

As also seen in FIG. 1, a portion of the bottom surface 16 of the disconnecting end 22 is convexly arcuately shaped to provide a leverage pivot point 26 intermediate the disconnecting end 22 and the connecting end 24. It is to be understood that the actual location of the leverage pivot point 26 will vary depending on the angle between the lever body 12 and the surface on which the bottom portion of the snap fastener is attached. This feature assists in disconnecting fasteners located in relatively confined or hard-to-reach spaces.

As shown in FIG. 2, the terminus of the disconnecting end 22 defines a forked end 30. The forked end 30 defines a first tine 32 and a second tine 34 and a semicircular notch 36 therebetween. The notch 36 is beveled on the top surface 14 of the lever body so that the tines 32,36 of the forked end 30 are shaped and oriented to be engaged between a mated snap fastener. This engagement assists in placing one fastener piece in tangential alignment with the leverage point 26, and a downward or push force applied to the lever body 12 is transmitted to the engaged piece for disconnection.

For this purpose, the leverage pivot point 26 is preferably located rearward of the notch 30 and forward of the sloped top surface 28 for maximizing leverage in disconnecting fasteners. This feature of the preferred embodiment is particularly useful for disconnecting snap fasteners located near the hem edge of a protective cover.

As illustrated, the first tine 32, the second tine 34 and the beveled notch 36 preferably permit the forked end 30 to slip or wedge between the mated snap fastener piece (not shown) to engage the rounded head of a fastener piece including the female socket portion received on the notch 36. Once the tool 10 is so engaged, a downward or push force applied to the lever body 12 is transmitted through the leverage pivot point 26 to the engaged piece to disconnect the female portion from the male portion of the snap fastener.

In an alternative tool embodiment, the size and shape of the disconnecting end 22 may be varied for engagement with variously shaped fastener pieces by releasably mounting an adapter (not illustrated) having an end portion configuration different in size and shape than the forked end 30. For this purpose the adapter construction can be a sleeve or a fitting releasably mounted over the existing forked end 30 as by friction fit or snap fit.

Figure 4:
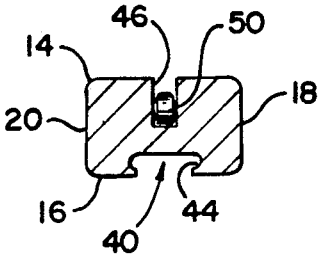
FIG. 4 is a cross-sectional view of the recess taken through lines 4—4 shown in FIG. 1.

As shown in FIGS. 1-3, for cooperation with the connecting features, the terminus of the connecting end 24 is preferably blunted but is not so limited. As best seen in FIGS. 3 and 4, a snap fastener connecting feature of the preferred embodiment is defined by the bottom portion 16 of the lever body 12 as a recess 40 located adjacent the terminus of the connecting end 24. The recess 40 is shaped and oriented to releasably receive and releasably capture the piece of a snap fastener S which includes the female socket portion F for either connecting or disconnecting the fastener. Typically the rounded head portion H of the top prong member of a snap fastener S has a sufficient rim edge available above the material to which it is attached to grasp for capture.

As best seen in FIGS. 1 and 3, the recess 40 has an open receiving portion 42 adapted to releasably receive therein the rounded head portion H of the snap fastener piece S as shown in FIG. 1. Once received, the piece is then moved in the direction shown by the arrow in FIG. 1 toward the blunted terminus through the open continuous passageway 41 into a capturing undercut portion 44. The capturing undercut portion 44 (best seen in cross-section in FIG. 4) is shaped and oriented in relation to the open receiving portion 42 to releasably capture the rim of the head piece and hold the piece while a pull force is applied for operably connecting or disconnecting the fastener.

When the tool 10 is then pulled in the direction of the disconnecting end 22, the top prong member of the snap fastener will travel through the open continuous passageway 41 into the undercut portion 44 which captures the head piece H of the snap fastener S by the rim of the top prong member located above the material M. The gap between the undercut and the bottom surface 16 of the lever body 12 allows the material M and the female socket portion F to freely extend outside the lever body 12 and avoids tearing or ripping of the material in the area of the fastener.

For connecting snap fasteners using the recess feature, the user captures the head portion H of the snap fastener S between the top prong member and the anchored material (as shown in FIG. 1) in the capturing undercut portion 44 as described above. In the preferred embodiment, the user then pulls the lever body 12 in the direction of the disconnecting end 22 while grasping the lever body 12 with one or two hands, as needed, to position the captured female socket portion of the fastener head over the corresponding stud of the male portion to which it is to be snap mated. Once the captured snap fastener piece is positioned over the corresponding stud portion, a downward force exerted on the lever body 12 will "snap" the stud portion onto the female socket. The tool 10 is then disengaged by reversibly sliding the captured piece of the snap fastener through the continuous passageway 41 to the open receiving portion 42 and removing the tool.

The open receiving portion 42 and the capturing undercut portion 44 are each shaped and oriented to have the open continuous passageway 41 permit the free movement of the received or captured piece of the snap fastener between each portion of the recess. In the preferred embodiment, the open receiving portion 42 and the capturing undercut portion 44 are linearly oriented along the length of the tool 10 with the capturing undercut portion 44 positioned opposite the disconnecting end 22 towards the blunted connecting end 24. Pull force applied to the lever body 12 will be transmitted through the lever body 12 to the fastener piece through the recess 40 by way of the capturing undercut portion 44.

This particular recess feature of the tool 10 can be used to assist in either connecting or disconnecting snap fasteners. Often, the construction of the surface material or the surface where it is attached does not allow the forked end 30 of the hand tool 10 to be easily inserted underneath the surface material for engagement with the disconnectable snap fastener piece. In this situation, the recess 40 also can assist in disconnecting such a snap fastener.

To use the recess 40 for disconnecting a snap fastener, the user grasps the hand tool 10 by the lever body 12 and repeats the steps described above for capturing the head portion H of the snap fastener S. The user can then exert an upward pry force on the lever body 12 which is translated by way of a second leverage pivot point 45 into an upward force on the head piece of the snap fastener held by the capturing undercut portion 44. In this instance, the second leverage pivot point 45 is located at the juncture where the blunted connecting end 24 meets the bottom surface 16. Thus, the recess feature of the connecting end of the hand tool 10 provides an alternative option to the forked end for disconnecting snap fasteners.

In an alternative embodiment, an adapter (not shown) can be releasably inserted into the recess 40 to allow the hand tool 10 to be used with multipiece fasteners having different sizes and shapes. The adapter is preferably a fitting formed of resilient material which can be releasably mounted as by snap fit or friction fit in the existing recess 40. The adapter can define a recess which is shaped substantially similar to recess 40, only smaller, or define a different shape and size.

As seen in FIG. 2, the top surface portion 14 of the connecting end 24 of the lever body 12 preferably defines a groove 46 to cooperatively receive an elongated zipper hook 50 pivotally mounted in the groove 46. The groove 46 is preferably oriented along the longitudinal axis to extend from the sloped surface 28 to the connecting end 24. A hook mounting means 48 is preferably located intermediate the connecting end 24 and the disconnecting end 22.

As illustrated in FIG. 2, the hook mounting means 48 can be a screw (shown in shadow) or a pin which extends through one sidewall of the lever body 12 to communicate and cooperate with the groove 46 to pivotally hold the zipper hook 50 in the groove 46. In FIG. 2, the hook mounting means 48 is inserted through the sidewall 20 but is not so limited.

The elongated zipper hook member 50 comprising a hook portion 52 and a stem end portion 54, is preferably mounted to the lever body 12 so that the zipper hook 52 can be rotatably placed in an open operative position 58 shown in shadow in FIG. 1 and in cross section in FIG. 4. For use, the zipper hook 50 pivots about the mounted stem end portion 54 to bring the hook portion 52 from a closed position 56 within the groove 46 to the open operative position 58 oriented 180 degrees from the closed position 56 so that the hook portion 52 is opposite the disconnecting end 22.

As illustrated in FIGS. 1 and 4, the zipper hook 50 is cooperatively held by the groove 46 and the terminus of the connecting end 24 for use. This cooperation provides sideways stability to the stem end portion 54 of the zipper hook 50. The zipper hook 50 is preferably dimensioned to engage a slot of either a zipper tab or a movable zipper head piece. Pull force is applied to the lever body 12 by the user in direction toward the disconnecting end 22 once the zipper piece is engaged by the hook portion 52. This pull force is transmitted to the hook portion 52 and hence to the moveable zipper piece.

In the preferred embodiment, the zipper hook 50 and the groove 46 cooperatively hold and secure the zipper hook 50 within the groove 46 during nonuse in the closed position 56, preferably with the opening of the hook portion 52 facing inwardly towards the lever body 12. In a simple form, this securement cooperation is preferably accomplished by bending either the zipper hook 50 or dimensioning the groove 46 such that the zipper hook is engaged within the groove 46 as by tension or friction in the closed position 56. A finger cavity 60 is preferably disposed at the terminus of the groove 46 adjacent the enclosed hook end portion 52.

For use, the finger cavity 60 allows the user to grasp, release and pivot the zipper hook 50 from the closed position 56 to the open position 58. The user then engages a slot on the moveable zipper piece with the hook portion 52. By pulling the lever body 12, the user can exert force on the moveable zipper piece via the slot to either connect or disconnect the interlocking teeth of the zipper, as desired. For this purpose, the hook mounting means 48 is preferably aligned above the recess 40 and near the terminus of the connecting end 24. This location preferably allows a sufficient length of the stem end portion 54 to be held in the groove 46 (best seen in FIGS. 1, 2 and 4) between the terminus of the connecting end 24 and the hook mounting means 48 to provide against sideways movement of the zipper hook while in use.

Means for securing the lever body about the user's hand for better pull leverage is also preferably provided. As illustrated, the securing means is a flexible lanyard 62 threadably mounted through the side walls 18, 20 of the lever body 12. The user can wrap the lanyard 62 about the hand when grasping the tool 10 to prevent slippage.

The lanyard 62 is particularly useful for auxiliary leverage when exerting a pulling force on the lever body 12 during use of the recess feature 40 or the zipper lock 50. When the lanyard 62 is wrapped about the user's hand, the problem of the hand slipping off the lever body 12 is also obviated. The lanyard 62 can also be used for hanging and storing the tool 10 when it is not in use.

A hand tool embodying the principles of this invention is preferably formed as a unitary lever body composed of a substantially solid material, such as plastic, wood, metal, rubber, plastic-coated metal, rubber-coated metal or combinations thereof. In particular, for use in a marine environment, the hand tool is preferably and desirably manufactured from a material which floats, i.e. one which has a density less than that of water. For this purpose, buoyant wood, plastic, hollow tubes made of metal or plastic or tubes filled with buoyant material are preferred.

Additionally, a hand tool embodying the principles of this invention can be any overall dimension desired so long as it can be comfortably hand gripped for manual use. Satisfactory results have been found, especially for marine applications, with a tool of the type shown in FIGS. 1–4 having a length of preferably about 8.75 inches to about 9 inches (about 21 centimeters to about 23 centimeters) as defined from the terminus of the connecting end to the terminus of the disconnecting end, a substantially uniform width of about 1 inch to about 1.25 inches (about 2.5 centimeters to about 3.1 centimeters), and a side wall height of about 0.5 inch to about 0.75 inch (about 1 centimeter to about 2 centimeters) at the connecting end portion rearward of the leverage pivot point for the disconnecting end portion.

Although the present invention has been described with reference to preferred embodiments, numerous modification and variations can be made and still the result will come within the scope of the invention. No limitation with respect to the specific embodiments disclosed herein is intended or should be inferred.

What is claimed is:

1. A hand tool for the connection and disconnection of a multipiece fastener, the tool comprising a lever body having at least one disconnecting end and at least one connecting end opposite said disconnecting end, said connecting end including a capture means for releasably receiving and releasably capturing a fastener piece while force is applied toward the disconnecting end said capture means defined as a recess comprising an open receiving portion, an open capturing portion, and a continuous open passageway placing each portion in fluid communication with one another; the open portion being adapted to releasably receive one mateable piece of a snap fastener, the passageway being configured to permit free movement of the received piece to or from the capturing portion, and the capturing portion having an undercut shaped and oriented in relation to the open portion to releasably capture and hold the fastener piece while force is applied for operably connecting the captured piece with a corresponding mateable piece.

2. The tool of claim 1 wherein the disconnecting end is forked, the forked portion being shaped and oriented to engage a fastener piece in tangential alignment to the lever body for disconnection.

3. The tool of claim 1 wherein said recess is cooperatively shaped and oriented to assist with connection or disconnection when pull force, or upward force is applied and the disconnecting end is forked.

4. A hand tool for the connection and disconnection of a multipiece fastener, the tool comprising a lever body having at least one disconnecting end and at least one connecting end opposite said disconnecting end, said connecting end including a means for releasably receiving and releasably capturing a fastener piece while force is applied toward the disconnecting end; the disconnecting end being convexly arcuate and forked and the connecting end including a zipper hook.

5. The tool of claim 4 further comprising means for securing the tool disposed about a user's hand for use in exerting pull force.

6. The tool of claim 5 wherein the securing means comprises a lanyard.

7. The hand tool of claim 4 composed of a material with a density less than that of water.

8. The tool of claim 4 composed of a material selected from the group consisting of plastic, wood, metal, rubber, plastic-coated metal, rubber-coated metal, and combinations thereof.

9. A hand tool for the connection and disconnection of a multipiece fastener, the tool comprising a lever body having at least one disconnecting end and at least one connecting end opposite said disconnecting end, said connecting end including a capture means for releasably receiving and releasably capturing a fastener piece while force is applied toward the disconnecting end; the disconnecting end being forked; one portion of the connecting end defining said capture means as a recess; the recess being shaped and oriented for connection when pull force is applied; and another portion of the connecting end defining a groove having a zipper hook pivotally mounted therein intermediate the disconnecting end and the connecting end, the groove being dimensioned to cooperatively hold the zipper hook in either an open position during use or closed position during nonuse.

10. The tool of claim 9 wherein the capture means is cooperatively shaped and oriented to assist in also disconnecting the fastener piece.

11. A hand tool for the connection and disconnection of multipiece fasteners, the tool comprising a substantially solid lever body suitable for grasping, the lever body having a disconnecting end and at least one connecting end opposite said disconnecting end;

the disconnecting end being both forked and convexly arcuate to provide a leverage point, said forked portion defining a semicircular notch adapted for releasably engaging the forked portion between two mated fastener pieces of a snap fastener such that a downward or push force manually applied to the lever body transmits through the leverage point to operably disconnect the fastener; and the connecting end portion of the lever body defining a recess, said recess being cooperatively shaped and oriented to releasably receive and releasably capture a snap fastener piece such that a pull force or upward force applied toward the disconnecting end of the lever body is transmitted to the captured fastener piece through the recess to assist respectively in operable connection with or disconnection from a corresponding mateable fastener piece; the recess comprising an open receiving portion, an open capturing portion, and a continuous open passageway placing each portion in fluid communication with one another; the open portion being adapted to releasably receive the piece of a snap fastener cooperatively including the female socket portion, the passageway being configured to permit free movement of the received piece to or from the capturing portion, and the capturing portion having an undercut shaped and oriented in relation to the open portion to releasably capture the fastener piece and hold the piece while force is applied for operably connecting or disconnecting the fastener.

12. The tool of claim 11 wherein the notch is beveled on one surface.

13. The tool of claim 11 further comprising means for securing the tool about a user's hand in exerting pull force.

14. The tool of claim 13 wherein the securing means comprises a lanyard.

15. The tool of claim 11 composed of a material with a density less than that of water.

16. The tool of claim 15 wherein the material is plastic.

17. A hand tool for the connection and disconnection of multipiece fasteners, the tool comprising a substantially solid lever body suitable for grasping, the lever body having a disconnecting end and at least one connecting end opposite said disconnecting end;

the disconnecting end being both forked and convexly arcuate to provide a leverage point, said forked portion defining a semicircular notch adapted for releasably engaging the forked portion between two mated fastener pieces of a snap fastener such that a downward or push force manually applied to the lever body transmits through the leverage point to operably disconnect the fastener; and the connecting end portion of the lever body defining a recess, said recess being cooperatively shaped and oriented to releasably receive and releasably capture a snap fastener piece such that a pull force or upward force applied toward the disconnecting end of the lever body is transmitted to the captured fastener piece through the recess to assist respectively in operable connection with or disconnection from a corresponding mateable fastener piece; and a zipper hook mounted on the connecting end of the lever body opposite the disconnecting end, such that when the zipper hook is attached to a moveable head piece of a zipper fastener, a pull force applied toward the disconnecting end is transmitted to the hook for operably connecting or disconnecting the fastener.

18. The tool of claim 17 wherein the zipper hook is pivotally mounted and a portion of the connecting end of the lever body further defines a groove dimensioned and adapted for cooperatively receiving the hook mounted therein intermediate the disconnecting end and the connecting end and for holding the hook in an open position during use and in a substantially enclosed position during nonuse.

19. A hand tool for the connection and disconnection of multipiece fasteners, the tool comprising a lever body suitable for grasping, the lever body having a disconnecting end and a connecting end opposite the disconnecting end, the lever body being substantially solid comprising a top surface, a bottom surface, and two opposing side walls, the top surface, bottom surface and side walls cooperating with the connecting end to define a lever body having side walls which are dimensionally narrower in height at the disconnecting end than at the connecting end;

the disconnecting end being forked, the forked portion defining a semicircular notch, the notch being beveled on one surface for releasably engaging the forked portion between two mated fastener pieces of a snap fastener, the bottom portion of the disconnecting end being convexly arcuate to provide a leverage point intermediate the notch and the connecting end, such that a downward or push force manually applied to the lever body transmits through the leverage point to the engaged forked portion to operably disconnect the fastener;

the connecting end being blunted, the top portion of the connecting end including a zipper hook pivotally mounted intermediate the disconnecting end and the connecting end, the top portion of the connecting end further defining a groove extending from the blunted connecting end toward the disconnecting end, the groove being dimensioned and adapted for cooperatively releasably receiving the hook therein for mounting and for holding the hook in an open position opposite the disconnecting end during use and in a substantially enclosed position during nonuse, the hook being attachable to a moveable head piece of a zipper fastener for use such that a pull force applied toward the disconnecting end is transmitted to the hook for operably connecting or disconnecting the fastener; and the bottom portion of the connecting end of the lever body defining a recess, the recess comprising an open receiving portion, an open capturing portion, and a continuous open passageway placing each portion in fluid communication with one another; the open portion being adapted to releasably receive the piece of a snap fastener cooperatively including the female socket portion, the passageway being configured to permit free movement of the received piece to or from the capturing portion, and the capturing portion having an undercut shaped and oriented in relation to the open portion to releasably capture the fastener piece and hold the piece such that a pull force applied toward the disconnecting end operably connects the piece with or disconnects the piece from a corresponding mateable fastener piece.

20. The tool of claim 19 further including a lanyard; the side walls of the lever body each defining opposing openings for threadably mounting the lanyard therethrough intermediate the connecting end and the disconnecting end.

21. The tool of claim 19 composed of a material having a density lighter than water.

22. The tool of claim of 19 composed of a material selected from the group consisting of plastic, wood, metal, rubber, plastic-coated metal, rubber-coated metal and combinations thereof.

* * * * *